US005762150A

United States Patent [19]

Cheng et al.

[11] Patent Number: 5,762,150

[45] Date of Patent: Jun. 9, 1998

[54] DRILL ROD CHANGER ASSEMBLY

[75] Inventors: Eugene Y. T. Cheng, Roanoke; Stuart A. Connell, Buchanan; Danny S. Bailey, Troutville; Phillip A. Mayhew, Roanoke, all of Va.

[73] Assignee: Ingersoll-Rand Company, Woodcliff Lake, N.J.

[21] Appl. No.: 723,630

[22] Filed: Oct. 3, 1996

Related U.S. Application Data

[60] Provisional application No. 60/024,695 Sep. 06, 1996.

[51] Int. Cl.[6] ..... E21B 19/14; E21B 19/20

[52] U.S. Cl. ..... 175/52; 175/85; 414/22.66

[58] Field of Search ..... 175/85, 52; 414/22.65, 414/22.66, 22.71, 22.68, 22.67

[56] References Cited

U.S. PATENT DOCUMENTS

| | | | |
|---|---|---|---|
| 2,781,185 | 2/1957 | Robbins | 414/22.66 |
| 3,025,918 | 3/1962 | Leven | 175/85 |
| 3,913,751 | 10/1975 | Swartz et al. | 175/52 |
| 3,985,189 | 10/1976 | Jahnke et al. | 175/85 |
| 4,128,135 | 12/1978 | Mitchhart et al. | 175/52 |
| 4,449,592 | 5/1984 | Mayer | 175/52 |
| 4,455,116 | 6/1984 | Lindstedt et al. | 175/52 |
| 4,892,160 | 1/1990 | Schivley, Jr. et al. | 175/85 |
| 4,897,009 | 1/1990 | Powell | 414/22.66 |
| 5,284,375 | 2/1994 | Land, III | 294/88 |

FOREIGN PATENT DOCUMENTS

| | | | |
|---|---|---|---|
| 130676 | 4/1978 | Germany | 175/52 |
| 4-108992 | 4/1992 | Japan | 175/85 |
| 4-269295 | 9/1992 | Japan | 175/85 |
| 1059122 | 12/1983 | Russian Federation | 175/52 |

*Primary Examiner*—Hoang C. Dang
*Attorney, Agent, or Firm*—John J. Selko

[57] ABSTRACT

A drill rod changer assembly for a drill rig includes an elongated support shaft having a housing at each end for retaining ends of drill rods, the support shaft being adapted for removable attachment to a drill rig structure, a carousel-type drill rod spacer on the shaft and a pair of gripper arms adapted for removable attachment to a drill rig structure at spaced apart positions adjacent each end of the support shaft. A hydraulic actuation device rotates the support shaft and carousel drill rod spacer between a rod storage position and a rod usage position. Each gripper arm is moved between the drill rod storage and usage positions by hydraulic actuation devices on each arm. Each gripper arm carries a sliding gate member that opens and closes the housings in response to movement of the gripper arm. The support shaft, and each gripper arm assembly being supplied as modularized assemblies that can be individually attached and removed from a drill rig to expeditiously change between various lengths of drill rod.

7 Claims, 6 Drawing Sheets

DRILL ROD CHANGER ASSEMBLY

BACKGROUND OF THE INVENTION

This Application claims the benefit under Title 35, U.S.C. § 119(e) of U.S. Provisional application Ser. No. 60/024,695.

This invention relates generally to drill rigs and more particularly to carousel-type drill rod changers on drill rigs. In drilling operations, it is sometimes necessary to change drill rod lengths and or drill rod diameters. For such changes, prior art drill rigs require an operator to torch off or unbolt many individual components and install new components in their place, a complicated and time consuming process. Also, in order to permit the operator to move drill rods into and out of the storage carousel, a gate had to be independently operated by hydraulic or electrical means, a requirement that added to the number and complexity of required drill rod changer components.

The foregoing illustrates limitations known to exist in present drill rod changers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a drill rod changer assembly for attachment to a drill rig, said assembly comprising: an elongated support shaft having a longitudinal axis and terminating in an upper and lower end; means for attaching said support shaft to a drill rig for rotation about said longitudinal axis; an upper housing on said support shaft, adjacent said support shaft upper end, for housing a plurality of drill rod upper ends, said upper housing having an aperture therein for passage of drill rod upper ends; a lower housing on said support shaft, adjacent said support shaft lower end, for housing a plurality of drill rod lower ends, said lower housing having an aperture therein for passage of drill rod lower ends; drill rod spacer means on said support shaft for spacing a plurality of drill rods within said upper and lower rod housings in a position substantially parallel to said support shaft; a first gripper arm means, positioned adjacent to said upper rod housing, for simultaneously gripping and moving a drill rod from a storage position within said upper rod housing to a position for use in a drilling operation; a second gripper arm means, positioned adjacent to said lower rod housing, for simultaneously gripping and moving a drill rod from a storage position within said lower rod housing to a position for use in a drilling operation; said first and second gripper arm means adapted to act substantially simultaneously with each other; means for attaching said first and second gripper arm means to a drill rig; and means for activating said support shaft and said first and second gripper arm means.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
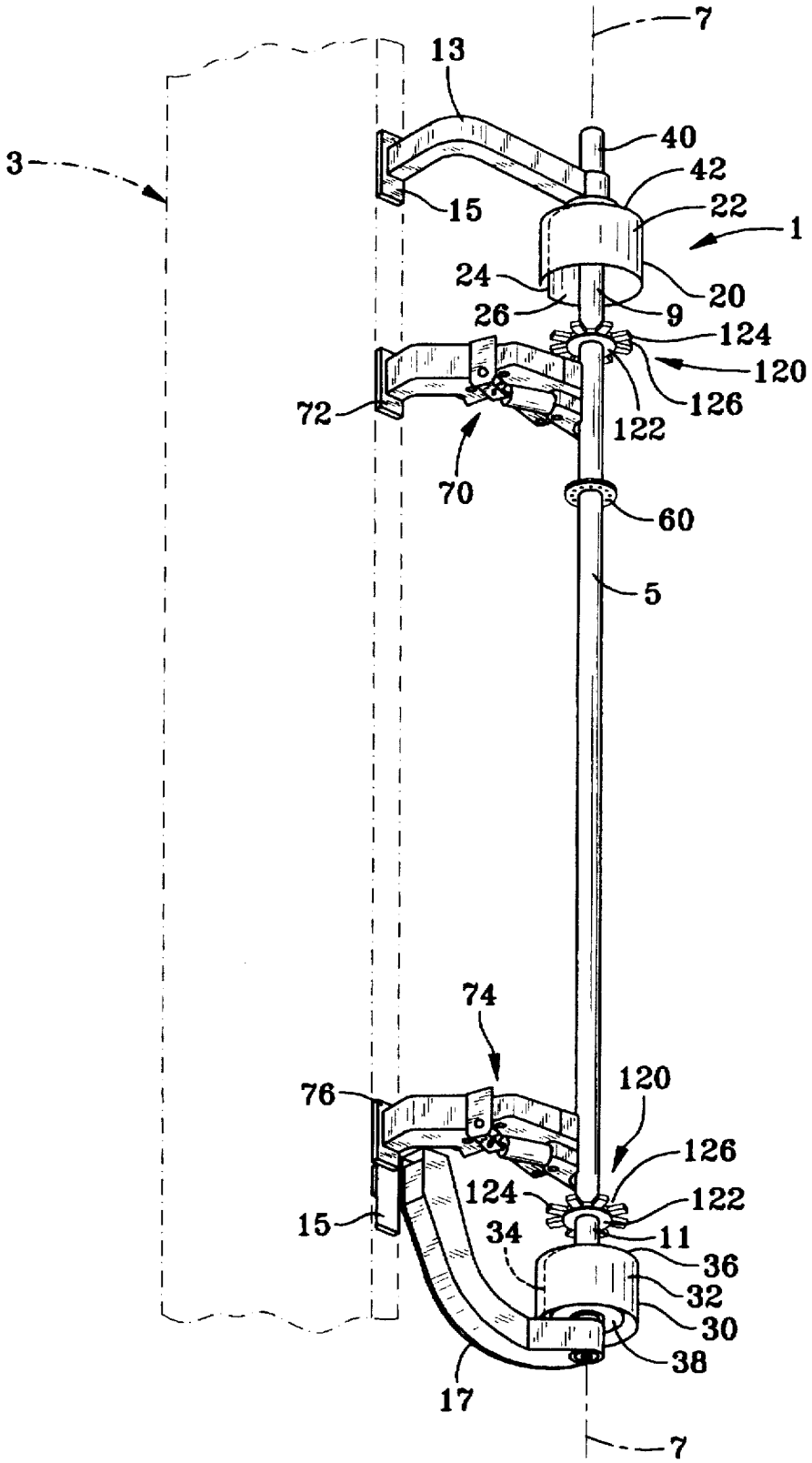
FIG. 1 is a perspective schematic view of the rod changer assembly of the invention.
Figure 5:
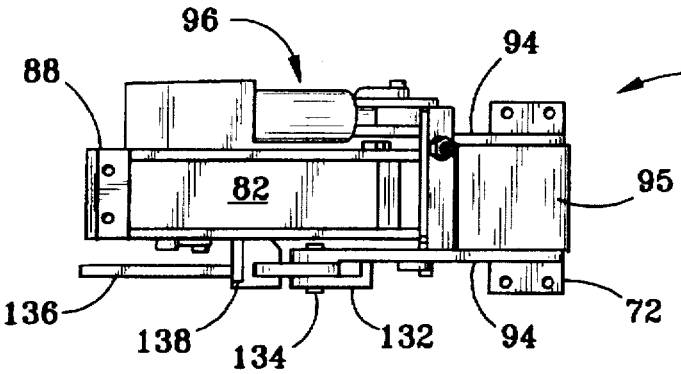
FIG. 5 is a view along 5—5 of FIG. 2.
Figure 2:
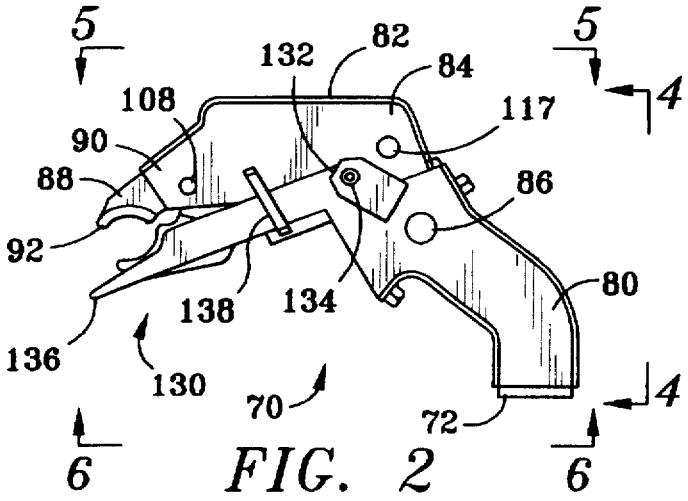
FIG. 2 is a top plan view of a gripper arm assembly of the invention pivoted into a position for storing drill rods.
Figure 4:
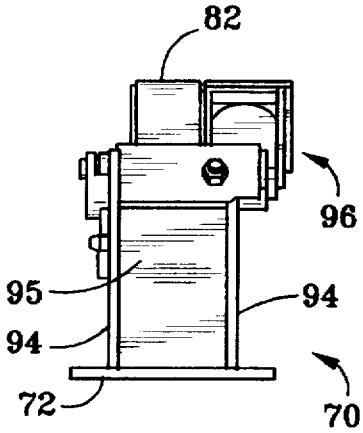
FIG. 4 is a view along 4—4 of FIG. 2.

FIG. 1 is a perspective schematic view of the rod changer assembly 1 of the invention depicted mounted on a conventional drill rig 3, shown in phantom. Rod changer 1 includes an elongated support shaft 5 having a longitudinal axis 7. Support shaft 5 terminates in an upper end 9 and a lower end 11. Means for attaching support shaft 5 to a drill rig 3 includes upper support beam 13 fastened, as by bolting, to rig 3 at flange 15. A second end of support beam 13 has journaled therein upper end 9 of support shaft 5. Lower support beam 17 is fastened to rig 3 in a fashion similar to upper support beam 13. A second end of support beam 17 has journaled therein lower end 11 of support shaft 5. Support shaft 5 is rotatable about axis 7.

Upper housing 20 is connected to support shaft 5 adjacent upper end 9, for the function of housing a plurality of drill rod upper ends (not shown). Upper housing 20 comprises a tubular body having a sidewall 22 encircling axis 7 and extending parallel thereto. Housing 20 has a longitudinally extending slot 24 for entry and exit of upper drill rod ends, as described hereinbelow. Housing 20 is open at bottom end 26.

Lower housing 30 is connected to support shaft 5 adjacent lower 11, for the function of housing a plurality of drill rod lower ends (not shown). Lower housing 30 comprises a tubular body having a sidewall 32 encircling axis 7 and extending parallel thereto. Housing 30 has a longitudinally extending slot 34 for entry and exit of lower drill rod ends, as described hereinbelow. Slots 24 and 34 are vertically aligned with each other to permit passage of a drill rod. Housing 30 is open at top end 36 and closed at bottom end 38 to support drill rods therein.

A hydraulic actuator 40, for rotating support shaft 5 is connected to upper end 9 of support shaft 5, adjacent to top end 42 of upper housing 20. Actuator 40 can be of any conventional design. As shown in FIGS. 14–17, support shaft 5 is a hollow tube, and upper end 9 of support shaft 5 terminates in a flange 46 within upper housing 20. A hollow tubular connector 48 is welded at one end 50 into support shaft 5. A second end 52 of tubular connector 48 is journaled in a bearing 54 for rotation. The inside sidewall surface of second end 52 is splined to receive matching splines on rotation shaft 56 of actuator 40, which is bolted to mounting member 58 on housing 20. Support shaft 5 can be made up of more than one section, which is connected to an adjoining section by a bolted flanged 60. The lower end 11 of support shaft 5 is rotatably journaled in a bearing, in similar fashion, but other conventional rotational connections can be used.

An upper gripper arm assembly 70 is bolted to drill rig 3 adjacent upper housing 20 at flange 72. A lower gripper arm 74 assembly is bolted to drill rig 3 adjacent lower housing 30 at flange 76. Gripper arm assemblies 70 and 74 are the same, and a description of one will suffice for the other.

Referring to FIGS. 2–7, upper gripper arm assembly 70 comprises a fixed support bracket 80 connected to flange 72, as by welding. Arm 82 is pivotally connected at a first end 84 to bracket 80 at pivot pin 86. A first jaw 88 is connected to second end 90 of arm 82. Jaw 88 carries a removable wear pad 92 for gripping drill rod, as is well known. First jaw 88 and arm 82 form a single structure, that moves in unison, without any relative movement between the two members, as described hereinbelow.

Figure 6:
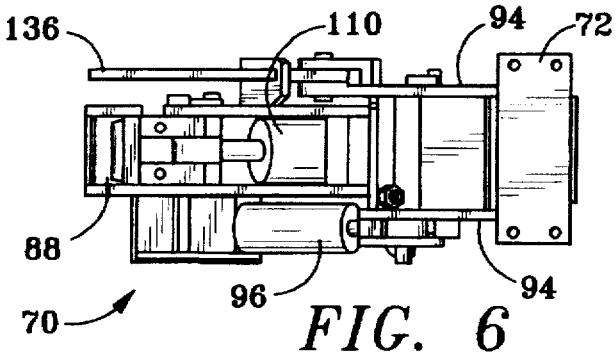
FIG. 6 is a view along 6—6 of FIG. 2.
Figure 7:
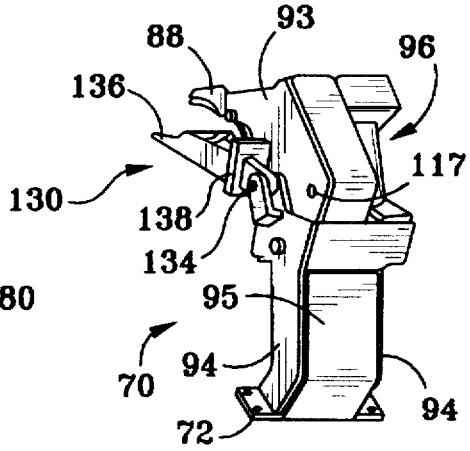
FIG. 7 is a perspective view of the gripper arm assembly of FIG. 2.
Figure 3:
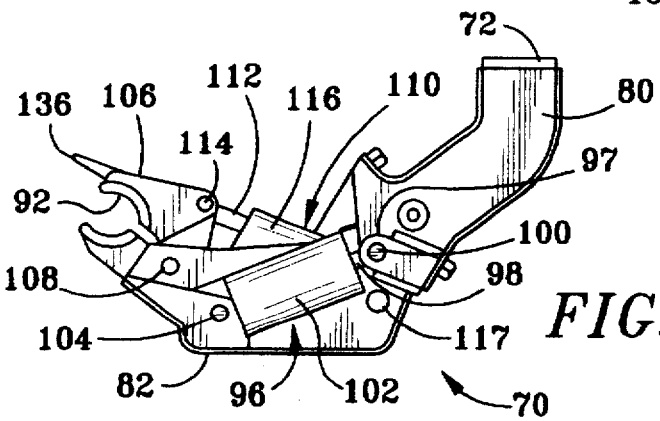
FIG. 3 is a bottom plan view of the gripper arm assembly of FIG. 2.
Figure 10:
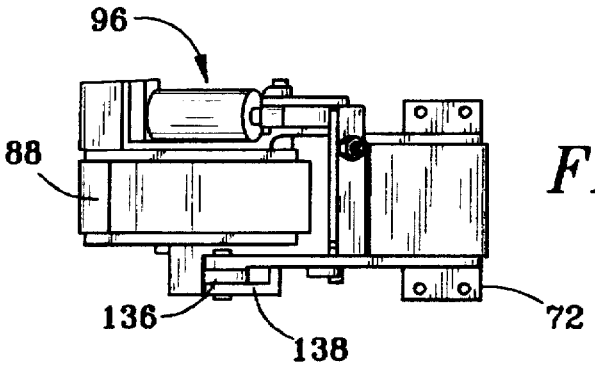
FIG. 10 is a view along 10—10 of FIG. 8.

Support bracket 80 is formed by two spaced apart plates 94 welded together by a cross plate 95. Arm 82 is formed by two spaced apart plates 93 and a cross plate 97 (FIG. 7). Arm 82 is positioned for movement between plates 94. A first hydraulic actuator 96 is pivotally connected at rod 98 to tab 97 on bracket 80 at pivot pin 100 (FIG. 3). Cylinder 102 is pivotally connected to arm 82 at pivot pin 104. Actuator 96 is positioned outboard of plates 94 (FIG. 6).

A second jaw 106 is pivotally connected to first jaw 88 at pivot pin 108. Jaw 106 carries a removable wear pad 92 for gripping drill rod, as is well known. A second hydraulic actuator 110 is pivotally connected at rod 112 to second jaw 106 at pivot pin 114. Cylinder 116 is pivotally connected to second arm 82 at pivot pin 117. Actuator 110 is positioned between plates 93 (FIG. 6).

Figure 8:
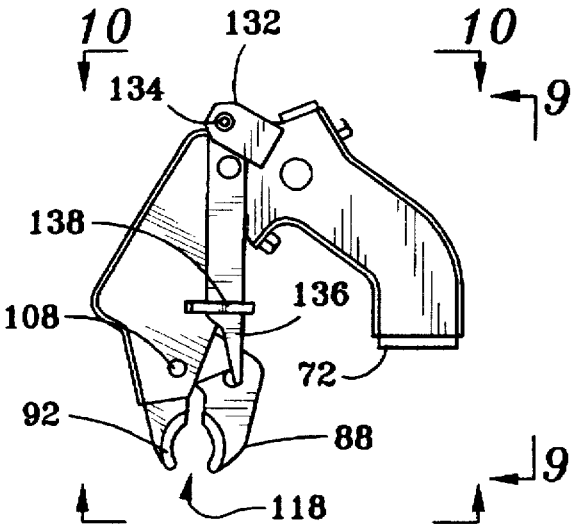
FIG. 8 is a bottom plan view of a gripper arm assembly of the invention pivoted into a position over a drill hole centerline.
Figure 9:
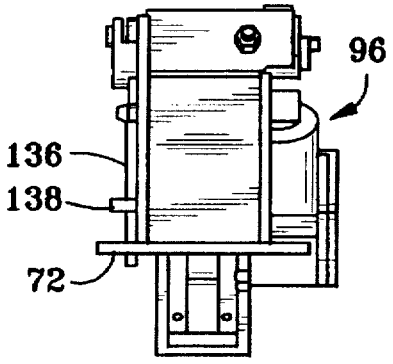
FIG. 9 is a view along 9—9 of FIG. 8.
Figure 11:
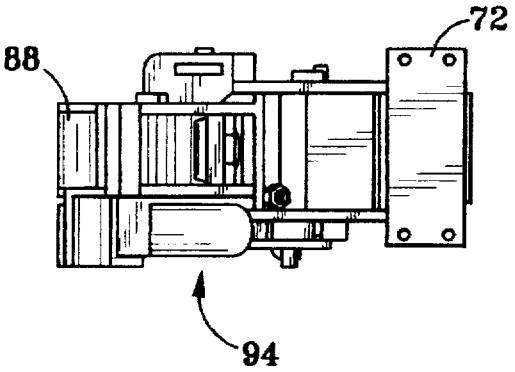
FIG. 11 is a view along 11—11 of FIG. 8.
Figure 12:
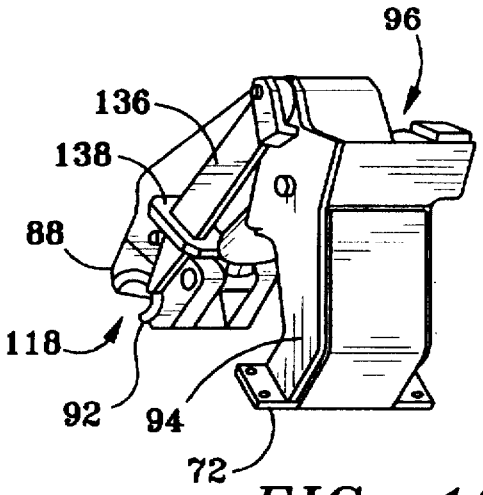
FIG. 12 is a perspective view of the gripper arm assembly of FIG. 8.

Thus, it can be understood that arm 82, first jaw 88 and second jaw 106 move in response to first actuator 96 between a first position above the drill hole centerline 118 (FIGS. 8, 13), characterized herein as a drill rod using position, to a second position away from drill hole centerline (FIGS. 1, 2 and 13), characterized herein, as a drill rod storage position. It can also be understood that second jaw 106 moves in response to second actuator 110 between a rod gripping position and a rod ungripping position.

FIG. 1 shows a rod spacer means 120, commonly called a rod carousel, comprising a pair of annular flanges 122 mounted on support shaft 5 transverse to axis 7. One flange is positioned adjacent to each drill rod housing 20, 30. Each flange includes a plurality of spaced apart sprockets 124 forming between each pair of sprockets 124 a recess 126 for receiving therein a drill rod, as is well known. We prefer a pair of flanges 122, but fewer or more can be used.

Figure 13:
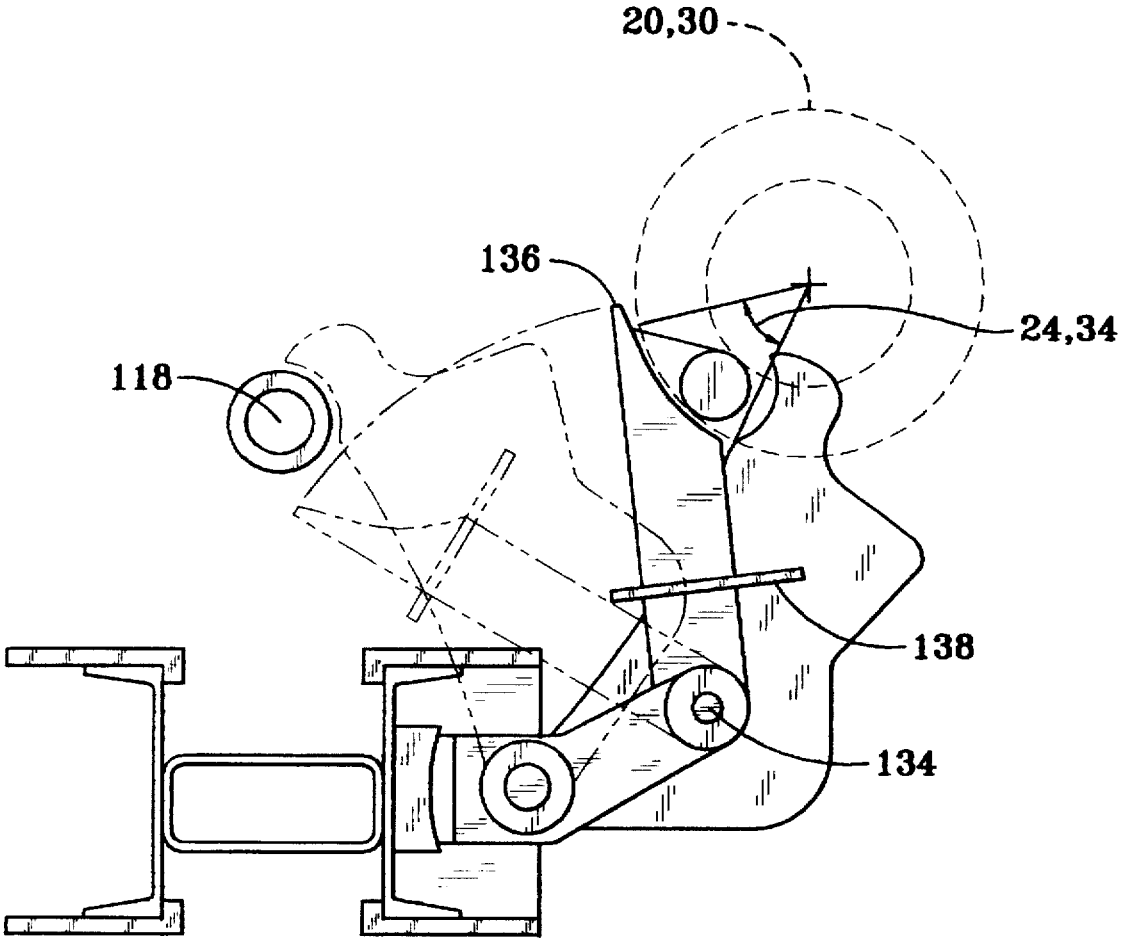
FIG. 13 is a schematic diagram, with parts removed, depicting a gripper arm assembly, in a first position, retaining a drill rod in a storage position, and, in a second position in phantom, depicting movement of a drill rod from a storage position to a position over a drill hole centerline.
Figure 17:
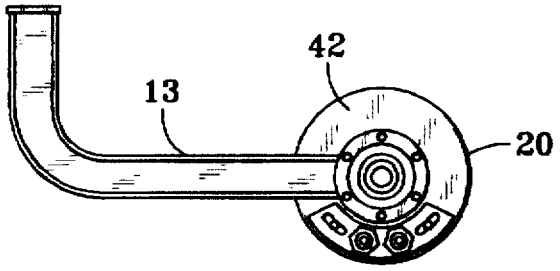
FIG. 17 is a view along 17—17 of FIG. 14.
Figure 15:
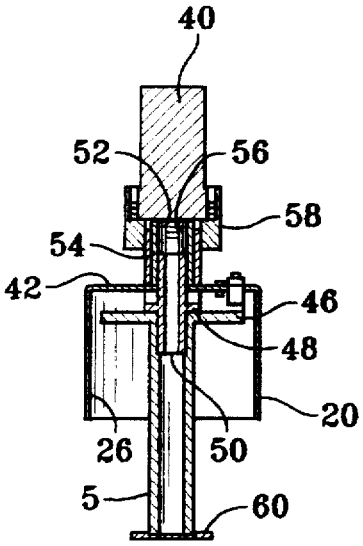
FIG. 15 is a cross sectional view along 15—15 of FIG. 14.
Figure 14:
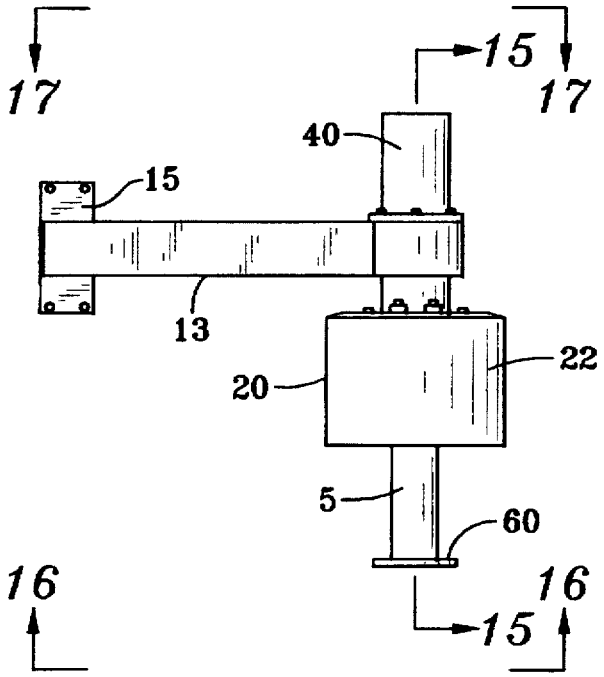
FIG. 14 is an elevational view of a top end of the support shaft of the invention with its upper support beam, a rotational actuator and a top drill rod housing.
Figure 16:
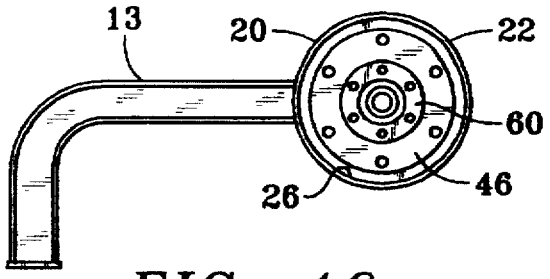
FIG. 16 is a view along 16—16 of FIG. 14.
Figure 18:
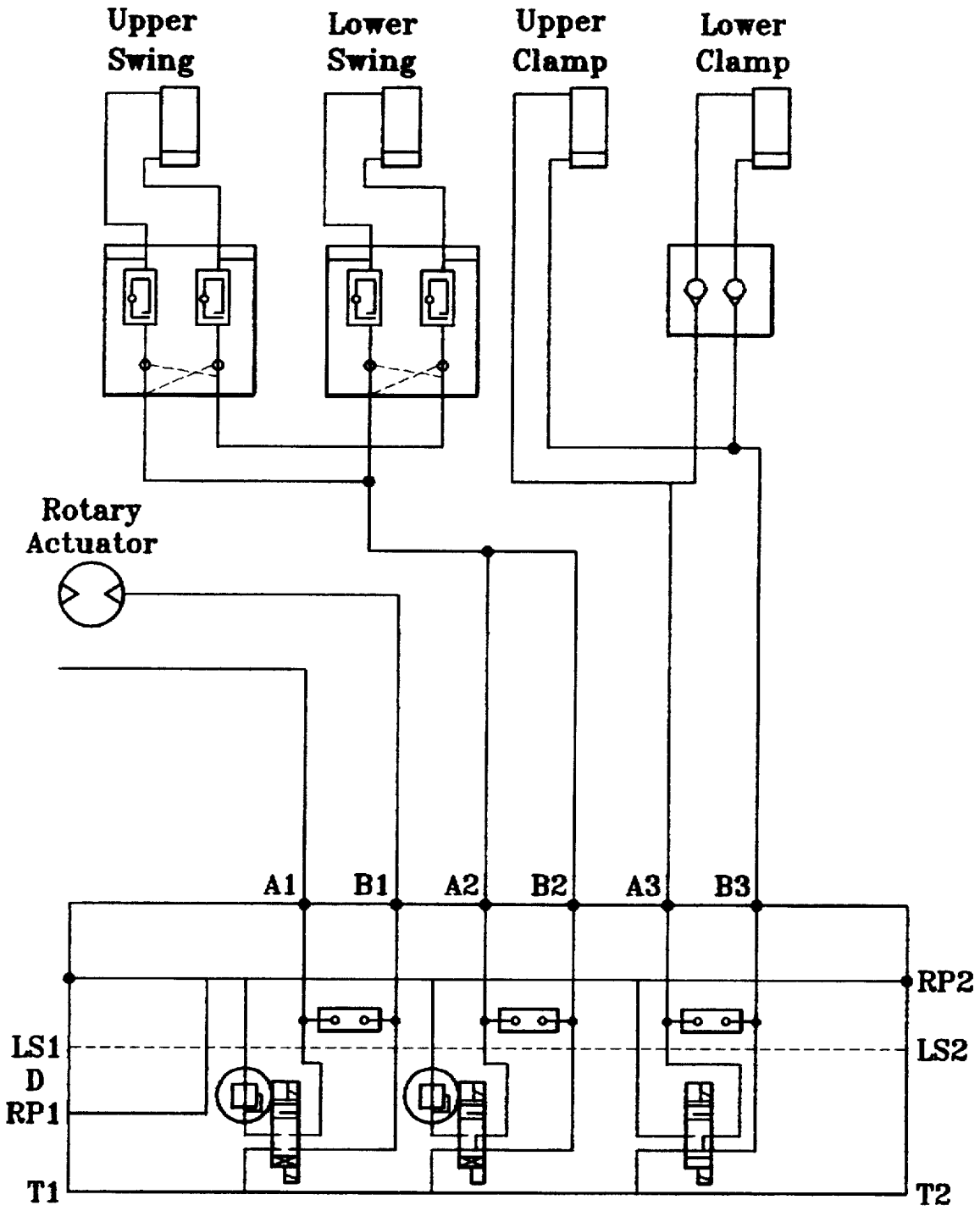
FIG. 18 is a schematic hydraulic circuit for the operation of the invention.

FIGS. 2,7,8 12 and 13 depict a sliding gate member 130, the function of which is to retain drill rod in the housings 20,30, and recesses 126 of rod spacers when the gripper arms are positioned in the drill rod storage position and to allow drill rod to remain above the drill hole centerline 118 while the gripper arms retract to a drill rod storage position. Gate member 130 comprises an elongated plate having a first end 132 pivotally connected to bracket 80 at pivot pin 134. A second end 136 is slidable through a guide 138 mounted on arm 82, in response to movement of arm 82. Thus, in a first position, the rod storage position, gate 130 is slidably extended through guide 138 to a position to block a drill rod from moving out of slots 24,34 in housings 20,30, as shown in FIG. 13, solid lines. In a second position, the rod using position, gate 130 is slidably retracted through guide 138 to a position to permit gripper arm assemblies 70,74 to rotate back to a rod storage position, as shown in FIG. 13, in solid lines, after depositing a drill rod above the drill hole centerline 118. End 136 is arcuate on one side so as to guide a drill rod into proper position with respect to the jaws 88, 106 when the carousel 120 rotates to position a new drill rod adjacent to slots 24,34 in housings 20,30.

The rod changer assembly of this invention is adjustable for different drill rod lengths and diameters. for a change of drill rod lengths, support shaft 5 can be lengthened (or shortened) by adding (or removing, respectively) intermediate sections connected at flanges 60. Each individual subassembly, i.e. support beams 13, 17 and gripper arm assemblies 70, 74 is provided as a single modularized unit that can be easily unbolted from the drilling rig and repositioned vertically to accommodate the new drill rod length. Also, where only a single drill rod is required to be added to the drill string, the rotatable carousel 120 can be eliminated and the larger housings 20,30 replaced with smaller housings adapted to accept a single drill rod. Different drill rod diameters can be accommodated by changing wear pads 92 and, if needed, drill rod spacers 120.

Having described the invention, what is claimed is:

1. A drill rod changer assembly for attachment to a drill rig, said assembly comprising:

(a) an elongated support shaft having a longitudinal axis and terminating in an upper and lower end;

(b) means for attaching said support shaft to a drill rig for rotation about said longitudinal axis;

(c) an upper housing on said support shaft, adjacent said support shaft upper end, for housing a plurality of drill rod upper ends, said upper housing having an aperture therein for passage of drill rod upper ends;

(d) a lower housing on said support shaft, adjacent said support shaft lower end, for housing a plurality of drill rod lower ends, said lower housing having an aperture therein for passage of drill rod lower ends;

(e) drill rod spacer means on said support shaft for spacing a plurality of drill rods within said upper and lower rod housings in a position substantially parallel to said support shaft;

(f) a first gripper arm means, positioned adjacent to said upper rod housing, for simultaneously gripping and moving a drill rod from a storage position within said upper rod housing to a position for use in a drilling operation;

(g) a second gripper arm means, positioned adjacent to said lower rod housing, for simultaneously gripping and moving a drill rod from a storage position within said lower rod housing to a position for use in a drilling operation;

(h) said first and second gripper arm means adapted to act substantially simultaneously with each other;

(i) means for attaching said first and second gripper arm means to a drill rig;

(j) means for activating said support shaft for rotation about said longitudinal axis and for activating said first and second gripper arm means; and (k) gate means, responsive to movement of said first and second gripper arm means, for alternatively retaining a drill rod in said upper and lower drill rod housing or for permitting movement of a drill rod from said upper and lower drill rod housing.

2. The assembly of claim 1 further comprising means for rotating said elongated support shaft about said axis of rotation.

3. The assembly of claim 2 wherein said drill rod spacer means comprises at least one annular flange mounted on said elongated support shaft, transverse to said longitudinal axis of said support shaft, said flange having a plurality of spaced apart sprockets thereon forming between each pair of sprockets a recess for receiving therein a drill rod.

4. The assembly of claim 3 wherein said first gripper arm comprises:

(a) a bracket adapted for attachment to a drill rig;

(b) an arm pivotally connected at a first end to said bracket;

(c) a first jaw connected to a second end of said arm, said first jaw and arm movable between a drill rod storage position and a drill rod using position;

(d) a second jaw pivotally connected to said first jaw and movable between a drill rod gripping and ungripping position;

(e) a sliding gate member pivotally connected at a first end to said bracket, said gate member having a second end slidable through a guide mounted on said arm, in response to movement of said arm, between a first and second position, whereby in a first position, said gate member retains a drill rod within said drill rod housing, and in a second position, said gate member permits movement of a drill rod from said drill rod housing;

(f) a first hydraulic cylinder actuator connected to said arm and said bracket, for pivoting said first jaw and arm into and out of position; and (g) a second hydraulic cylinder actuator connected to said arm and said second jaw for pivoting said second jaw between said gripping and ungripping position.

5. The assembly of claim 4 wherein said upper drill rod housing comprises a tubular body mounted on said support element, said body having a sidewall encircling said longitudinal axis and extending parallel to said axis, with said housing aperture forming a longitudinally extending slot in said sidewall, said body adapted to encircle a drill rod.

6. The assembly of claim 5 wherein said lower drill rod housing comprises a tubular body mounted on said support element, said body having a sidewall encircling said longitudinal axis and extending parallel to said axis, with said housing aperture forming a longitudinally extending slot in said sidewall, said longitudinal slot in said lower drill rod housing being aligned with said longitudinal slot in said upper drill rod housing, said body adapted to encircle a drill rod.

7. The assembly of claim 6 further comprising:

(a) said support shaft be adapted for lengthening or shortening; and (b) means for vertically repositioning said first and second gripper arm assemblies on said drill rig to correspond to said lengthened or shortened support shaft.

* * * * *